US006213064B1

(12) United States Patent
Geung

(10) Patent No.: US 6,213,064 B1
(45) Date of Patent: Apr. 10, 2001

(54) DOUBLE THROW ENGINE

(76) Inventor: Wing Ping Geung, 31A Lot 5, Hang Tau, Sheung Shui, New Territories, Hong Kong (HK)

( * ) Notice: Subject to any disclaimer, the term of this patent is extended or adjusted under 35 U.S.C. 154(b) by 0 days.

(21) Appl. No.: 09/097,900

(22) Filed: Jun. 16, 1998

(51) Int. Cl.[7] ..... F02B 75/24
(52) U.S. Cl. ..... 123/54.1; 124/55.5
(58) Field of Search ..... 123/54.1, 55.2, 123/55.3, 192.1, 192.2, 197.4, 193.2, 193.3, 55.5, 55.7

(56) References Cited

U.S. PATENT DOCUMENTS

| | | | | |
|---|---|---|---|---|
| 2,398,864 | * | 4/1946 | Soher | 123/55.7 |
| 3,894,522 | * | 7/1975 | Bennett | 123/54.1 |
| 4,078,439 | * | 3/1978 | Iturriaga-Notario | 123/197.4 |
| 4,562,799 | * | 1/1986 | Woods et al. | 123/668 |
| 4,838,235 | * | 6/1989 | Kawamura et al. | 123/668 |
| 4,841,927 | * | 6/1989 | Slee | 123/668 |
| 4,850,313 | | 7/1989 | Gibbons . | |
| 4,921,734 | * | 5/1990 | Thorpe et al. | 123/668 |
| 5,046,459 | * | 9/1991 | Stiller et al. | 123/55.5 |
| 5,228,416 | * | 7/1993 | Puzio | 123/55.5 |
| 5,503,038 | * | 4/1996 | Aquino et al. | 123/55.5 |
| 5,782,213 | | 7/1998 | Pedersoen . | |

FOREIGN PATENT DOCUMENTS

4226185 A1 8/1992 (DE) .

OTHER PUBLICATIONS

Four Cylinders But Only Four Bearings, Alexander R.M: Engineerin (incl. Machine Shop Magazine), vol. 198, Jul. 24, 1964 , p. 107 XP002070097 issue: 0013–7782.

* cited by examiner

*Primary Examiner*—Marguerite McMahon
*Assistant Examiner*—Jason Benton
(74) *Attorney, Agent, or Firm*—Merchant & Gould P.C.

(57) ABSTRACT

An engine is described having pistons and cylinder arranged in mutually orthogonal pairs. Each pair is driven by a respective crank, with the pairs of cranks rotating about a primary crank which in turn rotates about an axis orthogonal to the axes of the pairs of pistons and cylinders. The throw of the respective cranks about the primary crank is the same as the throw of the primary crank about its axis. A counter-balancing weight is provided opposite to the primary crank. The resulting engine is balanced and lateral forces on the cylinder wall are reduced allowing the use of ceramic materials for the cylinders.

11 Claims, 16 Drawing Sheets

DOUBLE THROW ENGINE

FIELD OF THE INVENTION

This invention relates to an engine, and in particular to an improved form of engine that is better balanced than the prior art. The invention may be applied to an internal combustion engine, hydraulic or pneumatic pumps and/or motors, a compressor and the like.

BACKGROUND OF THE INVENTION AND PRIOR ART

A problem with known engines, be they IC engines, hydraulic pumps, compressors and the like, that have pistons moving in cylinders, is that a consequence of the piston being driven from a rotating crank is that there are lateral forces that act cyclically on the walls of the cylinder as the piston goes through one cycle of operation. The presence of these lateral forces places a number of restrictions on the design of the cylinders since they must be designed in such a way as to overcome these problems.

SUMMARY OF THE INVENTION

According to the present invention there is provided an engine comprising at least two pairs of pistons and cylinders, said pairs being disposed along mutually orthogonal first and second axes, said pairs being driven by respective first and second cranks, said first and second cranks rotating about a primary crank, said primary crank in turn rotating about a third axis orthogonal to said first and second axes, said first and second cranks having a radius of throw from said primary crank equal to the radius of throw of said primary crank from said third axis.

Preferably a counter-balancing weight is provided opposite said primary crank.

The engine may be a four-cylinder engine having two pairs of orthogonally disposed cylinders, or may be an eight-cylinder engine, having four pairs of cylinders and wherein the cylinders are divided into two groups of four disposed in parallel planes, each plane comprising two mutually orthogonal pairs.

A major advantage of the present invention is that by selecting the correct counter-balancing weight all lateral forces on the cylinders may be eliminated or at least substantially reduced and this permits the use of alternative materials for the cylinder construction. Preferably therefore the cylinders are formed of a ceramic material.

In a particularly preferred embodiment the ceramic cylinders are pre-stressed. This may be achieved by forming the external surface of each cylinder with an at least partially tapering portion, and providing an annular surrounding member having an inner surface tapering in the opposite sense to the external surface of the cylinder, and means being provided for urging said surrounding member such that said tapering surfaces are brought together to generate a radially inwardly directed force. Preferably the urging means comprises spring means.

Viewed from another aspect the present invention provides an engine having four pairs of pistons and cylinders, said four pairs being grouped into two groups of two pairs in each group, the piston and cylinder pairs in each group being disposed on mutually orthogonal first and second axes and being driven by first and second cranks respectively, said first and second cranks rotating about a primary crank, said primary crank rotating about a third axis orthogonal to the first and second axes and comprising three interconnecting sections, junctions between said three sections defining spaces for receiving the respective first and second cranks of said two groups of pistons and cylinders, each said first and second crank having a radius of throw from said primary crank equal to the radius of throw of said primary crank from said third axis, and a counterbalancing weight being provided at each junction opposite said primary crank.

Viewed from still another aspect the present invention provides a cylinder for an engine wherein said cylinder is formed of ceramic material, and wherein said cylinder has an external surface having two portions tapering in opposite senses, and wherein an annular surrounding member having an internal surface tapering in an opposite sense to a first of said two portion-surrounds said first of said two portions, and wherein urging means acts upon said surrounding member whereby the tapering internal surface of said surrounding member and said first tapering portion of said external surface of said cylinder are brought together to generate a radially inwardly directed force, and wherein an annular locking member surrounds said second tapering portion of the external surface of said cylinder and having an internal tapering surface of opposite sense to the said second tapering portion.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

Figure 1:
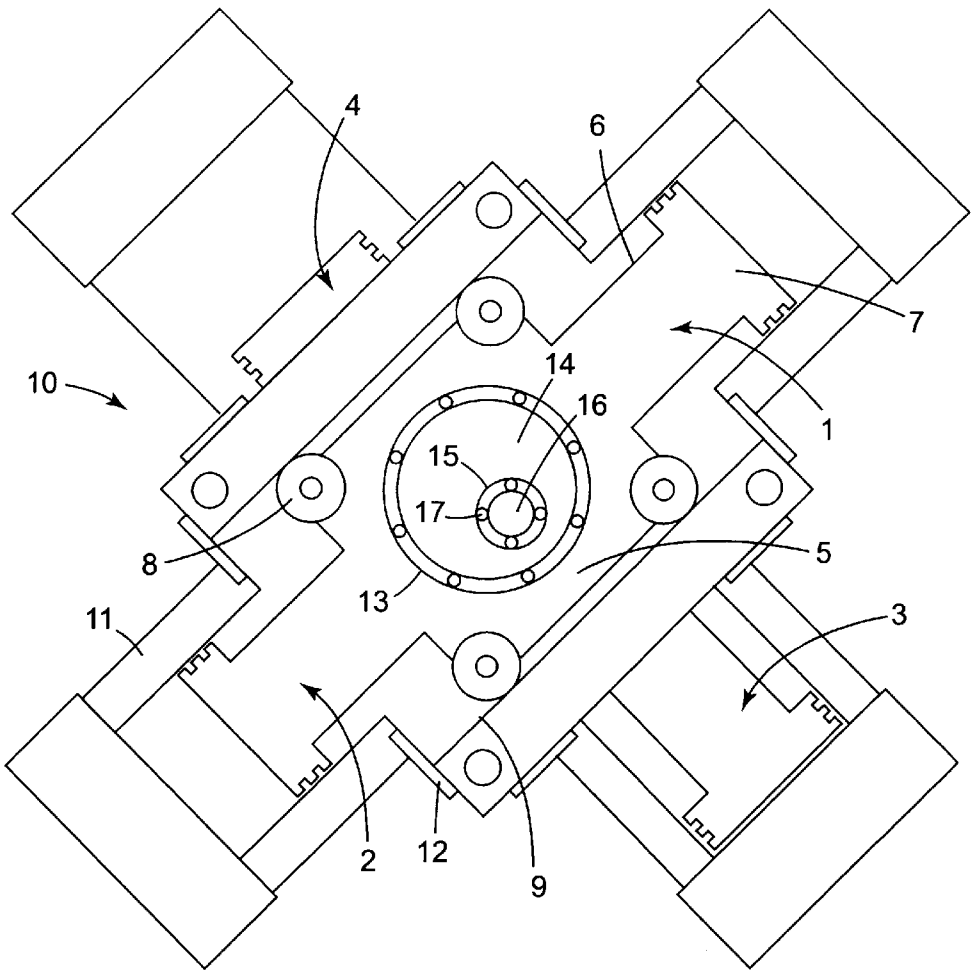
FIG. 1 is a plan view through part of an engine according to an embodiment of the invention showing the plane in which the pistons reciprocate.

Referring firstly to FIG. 1 there is shown a first embodiment of the present invention showing a double throw engine having two mutually perpendicular piston pairs. Since the invention can be applied to a large number of different applications, such as an IC engine, or a hydraulic motor, pump, compressor or the like, for clarity the description here will be limited to the piston, cylinder, crank construction. The remaining parts of the engine, e.g. the exhaust and inlet design, are conventional.

The two pairs of pistons do not however lie in the same plane but in two parallel planes, a first plane comprising pistons 1,2 being above a second plane in which are located pistons 3,4. In the following description for convenience reference shall be made to just one piston pair, but unless otherwise stated it should be understood that the description applies to both pairs equally.

Pistons 1,2 (and equivalently pistons 3,4) are formed integrally with and extend in opposite directions from a central piston body 5 and each piston comprises a piston shaft 6 with a piston head 7 at a distal end thereof. The piston body 5 is provided with four guide means 8, for example guide wheels, at each comer of the body 5—two on each side of the piston body 5. The guide wheels 8 are adapted to engage guide rails 9 formed on the interior of an engine block 10 so as to allow the piston body 5 and pistons 1,2 to reciprocate. It will be understood that pistons 1,2 are therefore always exactly 180° out of phase.

Pistons 1,2,3,4 reciprocate within respective cylinders 11 which will be described in greater detail below. In the meantime it is sufficient to note that the cylinders 11 are secured to the engine block 10 and guard plates 12 are provided at the ends of the guide rails to prevent lubricating fluid from leaking out of the guide rails 9 and engine block 10.

Formed in the centre of the piston body 5 is a circular crank receiving aperture 13 within which is located a first crank 14 to be described further below. Pin roller bearings are disposed between aperture 13 and crank 14 to permit rotation of the crank 14 within the aperture 13. Crank 14 is in turn provided with an aperture 15 in which is received a crank pin 16. Again bearings 17 or the like are provided to permit relative rotation of the crank 14 about the pin 16.

Figure 2:
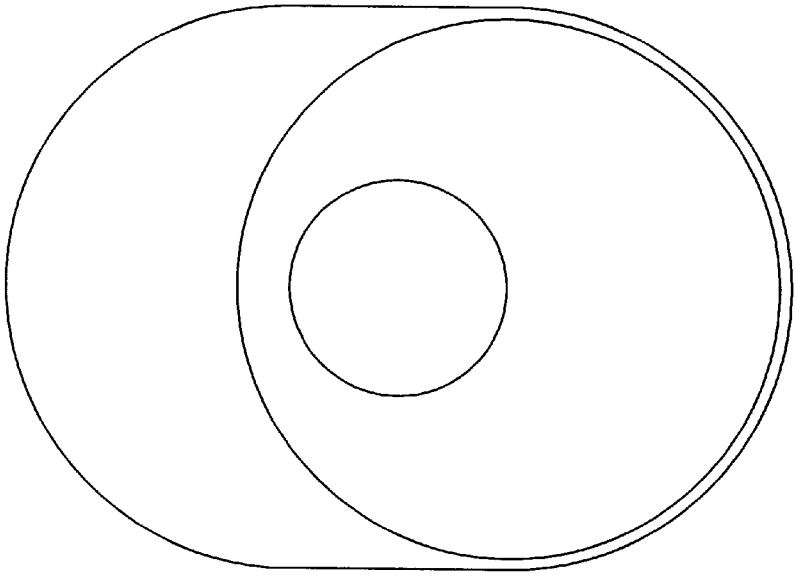
FIG. 2 is a view of first and second cranks.
Figure 2:
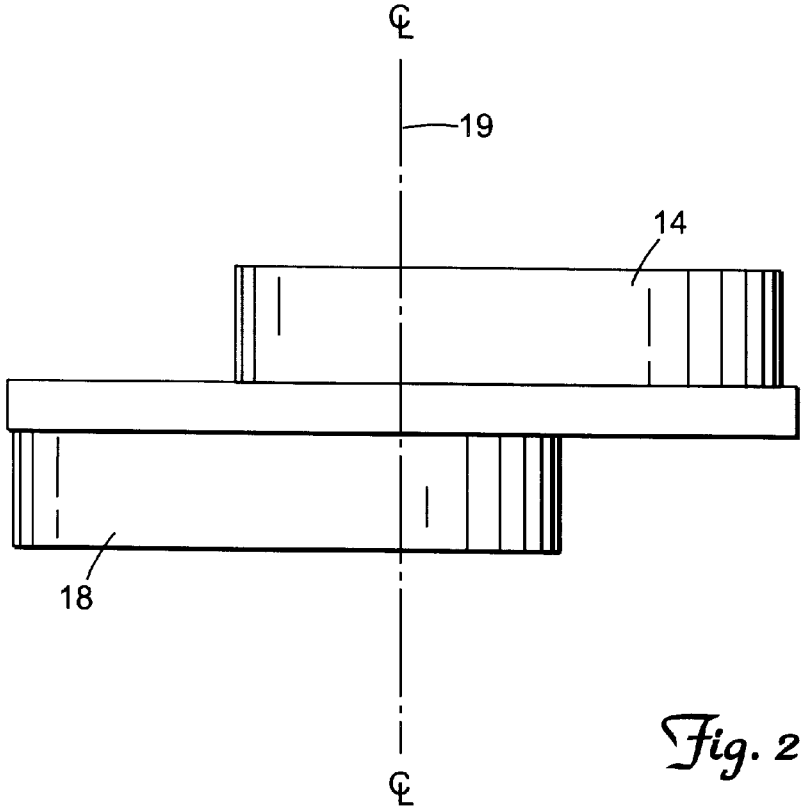

First crank 14 is one part of an integrally formed double-crank as shown in FIG. 2 the other part of the double crank is a second crank 18 which is identical to the first crank 14. The first and second cranks 14,18 are, however, offset by equal but opposite amounts with respect to a common crank axis 19 as shown in FIG. 2—that is to say they have the same radius of throw, but out of phase with each other. It will be understood that the second crank 18 is received within a crank aperture formed in the piston body of the second pair of pistons 3,4 in a manner corresponding identically to the crank 14 and the first piston pair 1,2.

Figure 3:
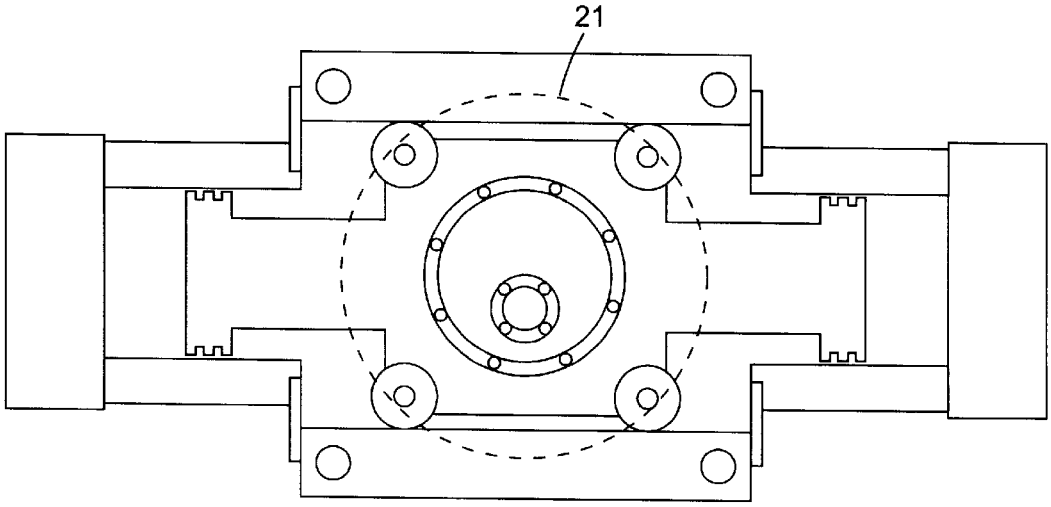
FIG. 3 shows the location of the counter-balancing weight receiving chamber.
Figure 4:
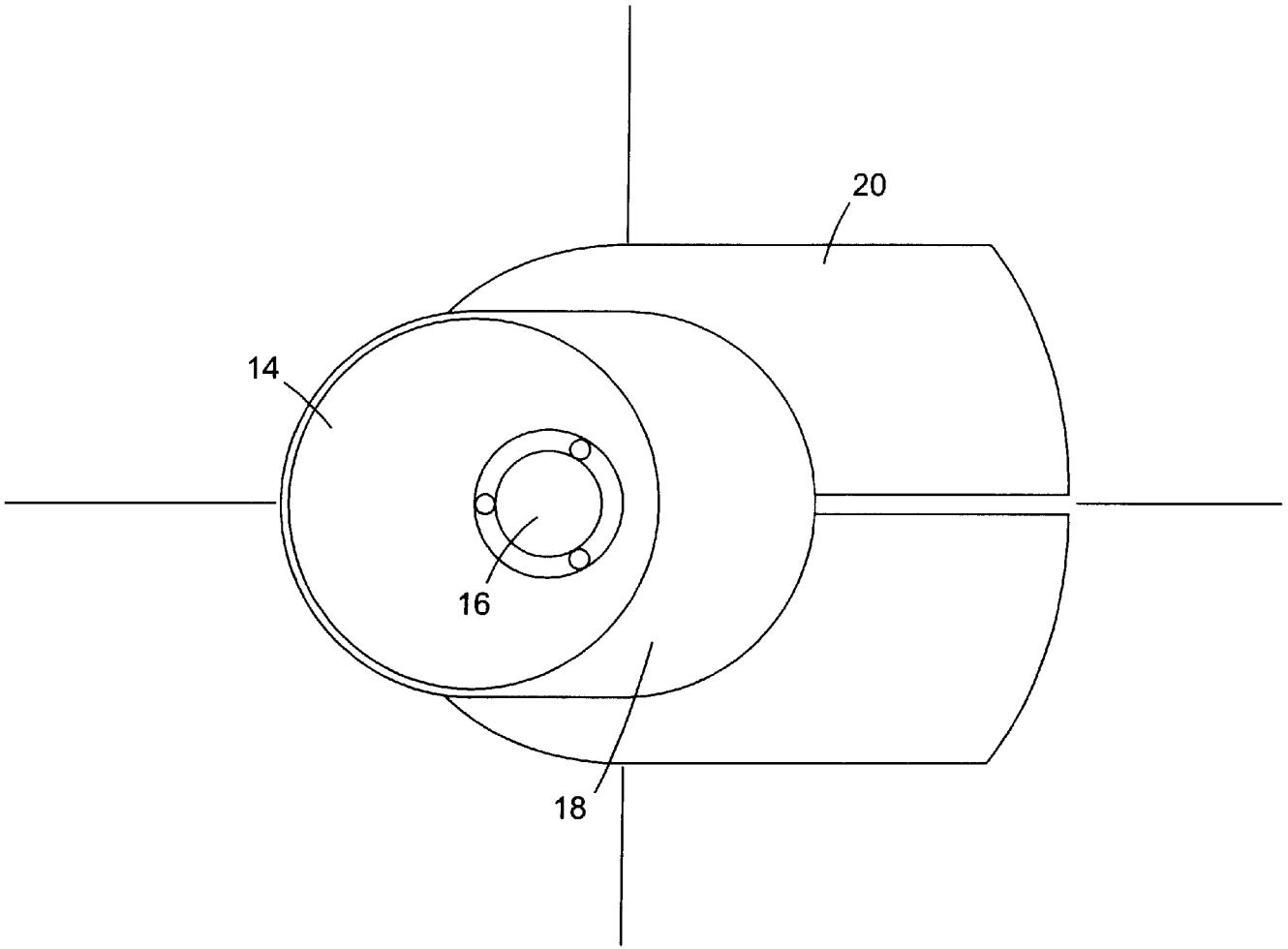
FIG. 4 shows the crank assembly.

As is also shown in FIG. 4 also fitted to the crank pin bearing first and second cranks 14,18 is a counter-balancing weight 20 which is adapted to rotate relative to the first and second cranks 14,18. The counter-balancing weight is received within a chamber 21 formed above the two superimposed piston bodies 5 (FIG. 3), the chamber being sized sufficiently to allow rotation of the counter-balancing weight 20.

Figure 16:
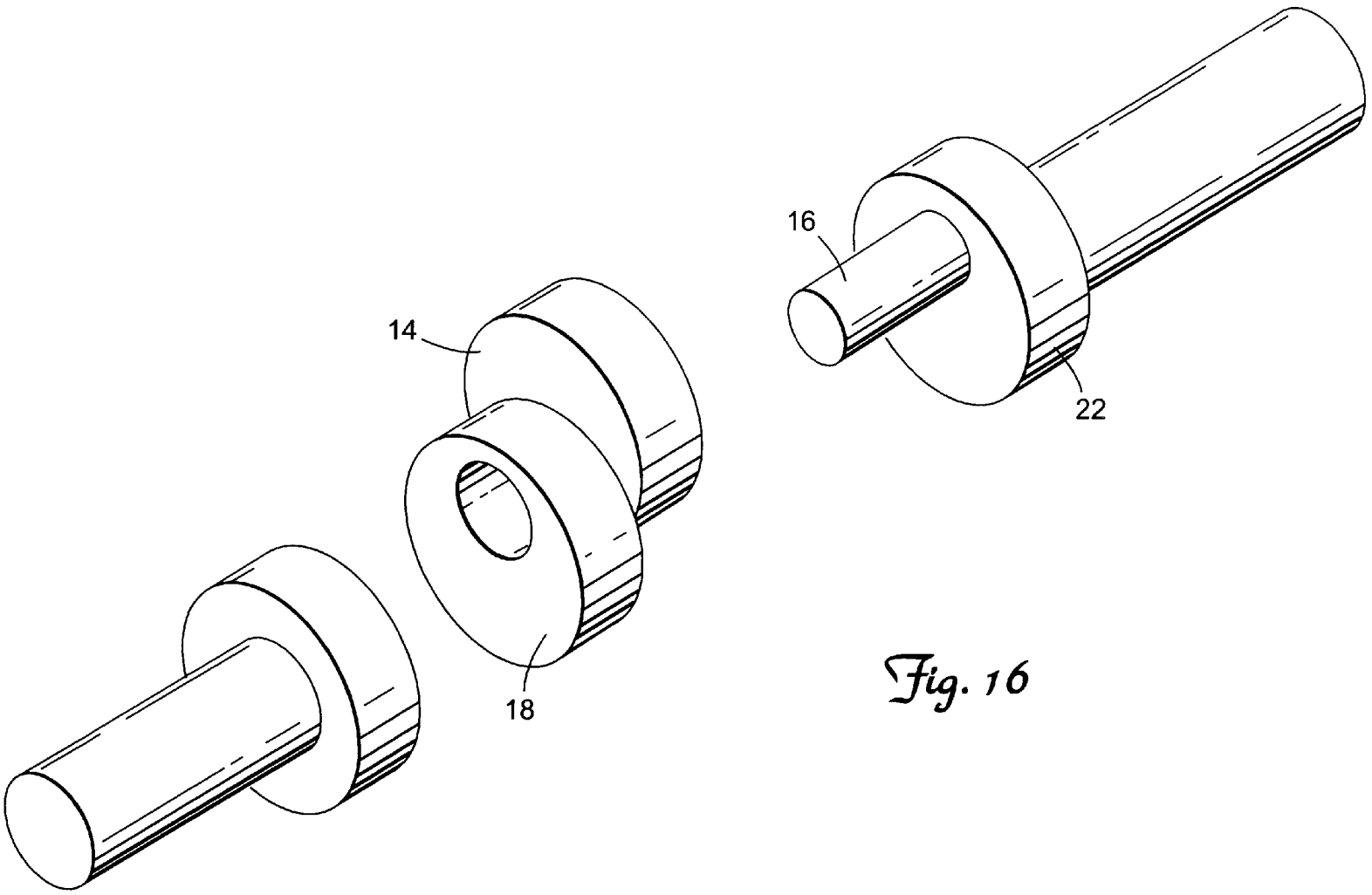
FIG. 16 is an isometric perspective view showing the relationship of the cranks

The crank pin 16 is formed with an integral primary crank 22 and FIG. 4 shows the assembly of the first and second cranks 14,18 located on the crank pin 16 bearing the primary crank 22. FIG. 16 shows the relationship between the first and second crank 14, 18 and the primary crank 22. The following figures illustrate the relative positions of the first and second cranks 14,18 and the primary crank 22. In these figures the axis x-x corresponds to the axis of reciprocation of pistons 1,2, while the axis y-y corresponds to the axis of reciprocation of pistons 3,4, it is orthogonal to axis x-x.

Figure 5:
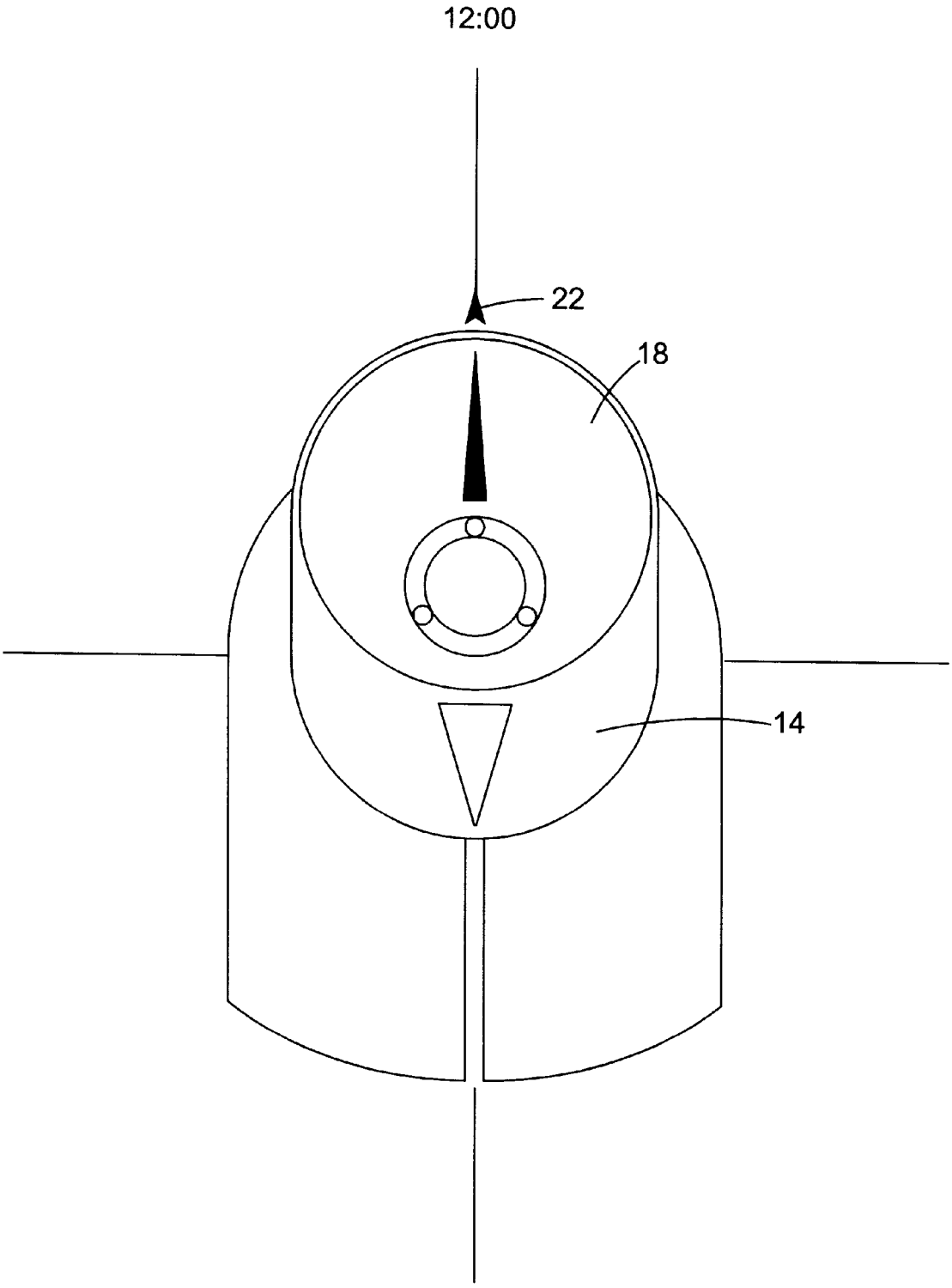
FIGS. 5 to 12 show the relative positions of the cranks during one firing cycle.
Figure 6:
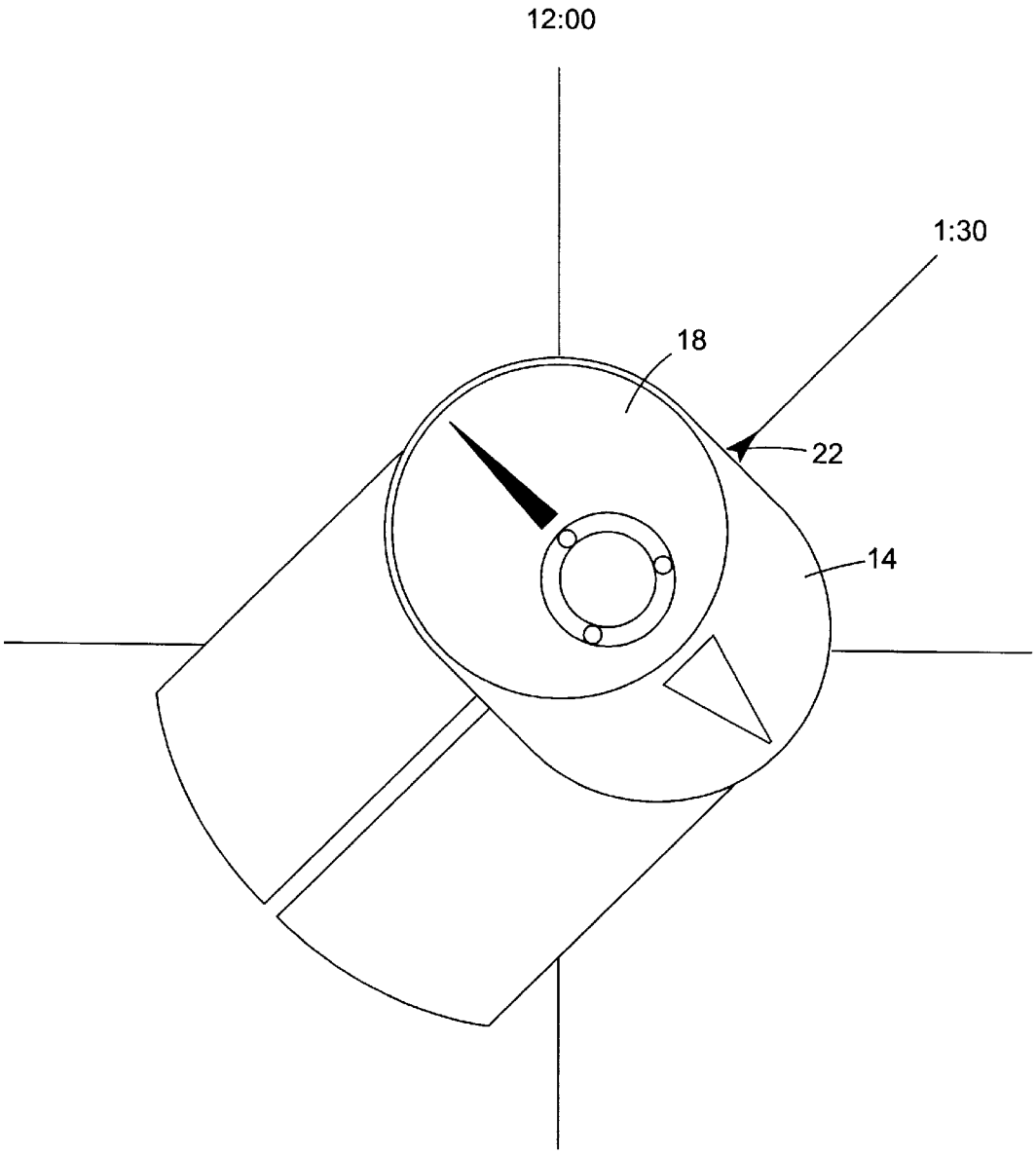
Figure 7:
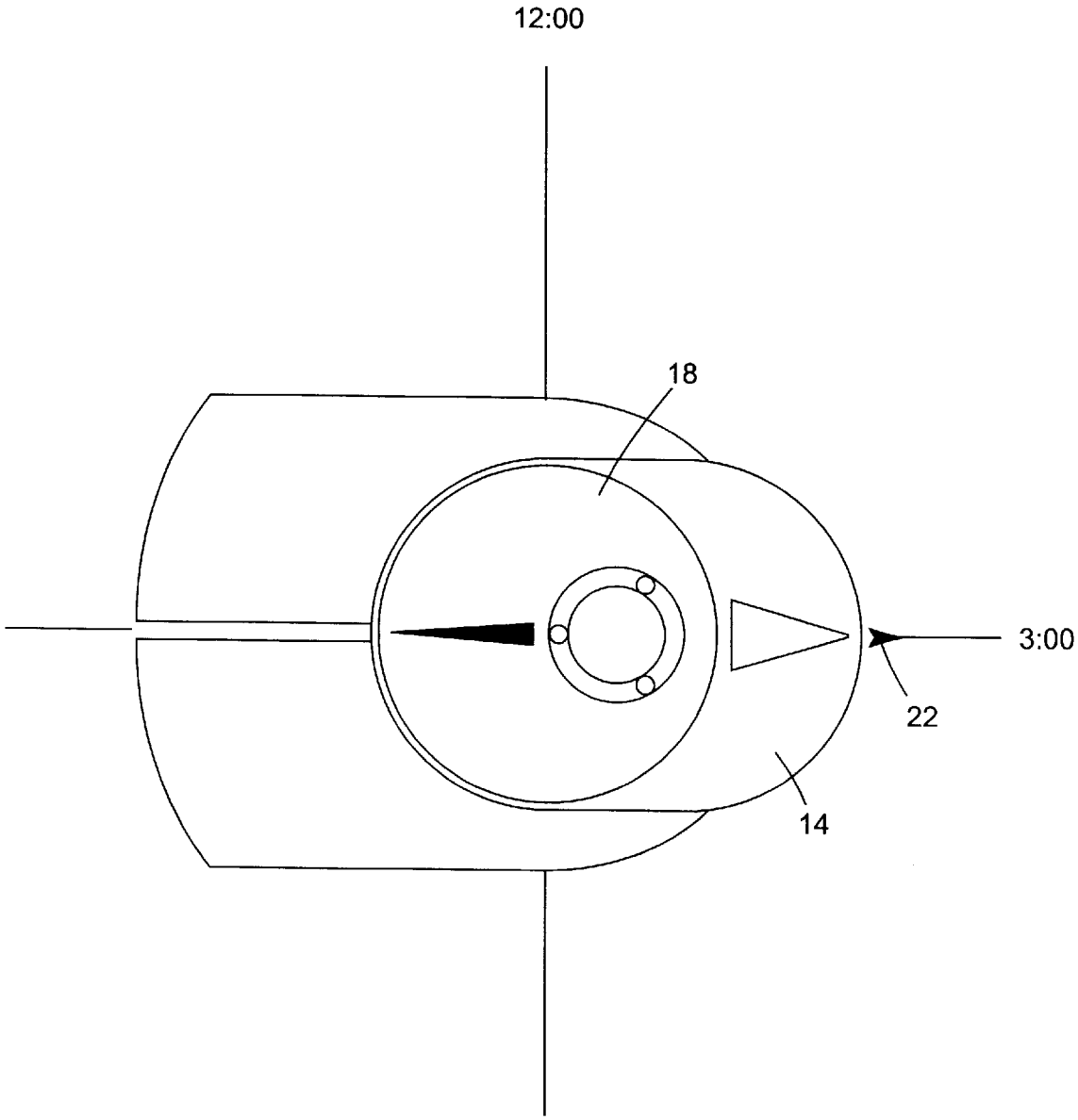
Figure 8:
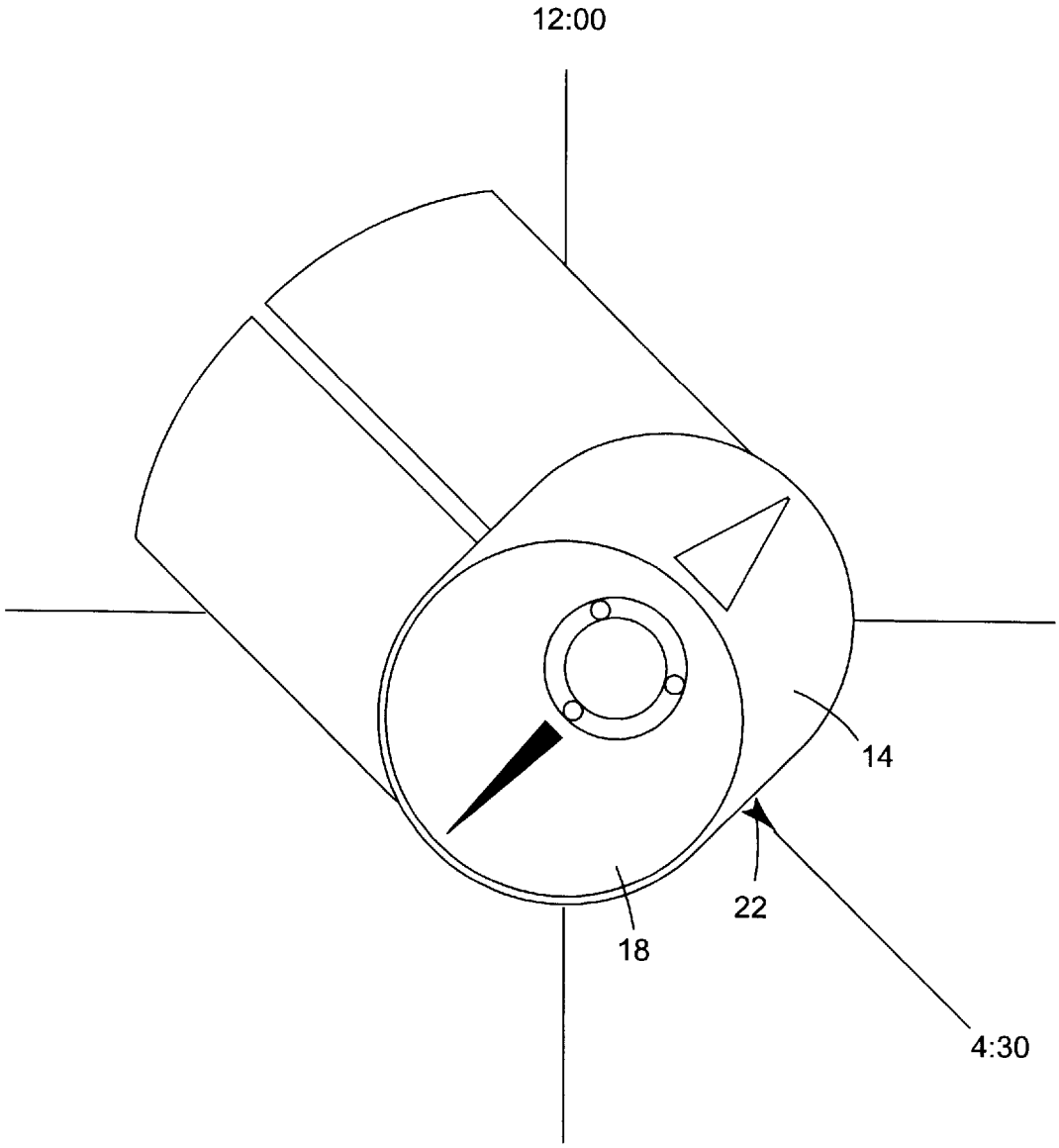
Figure 9:
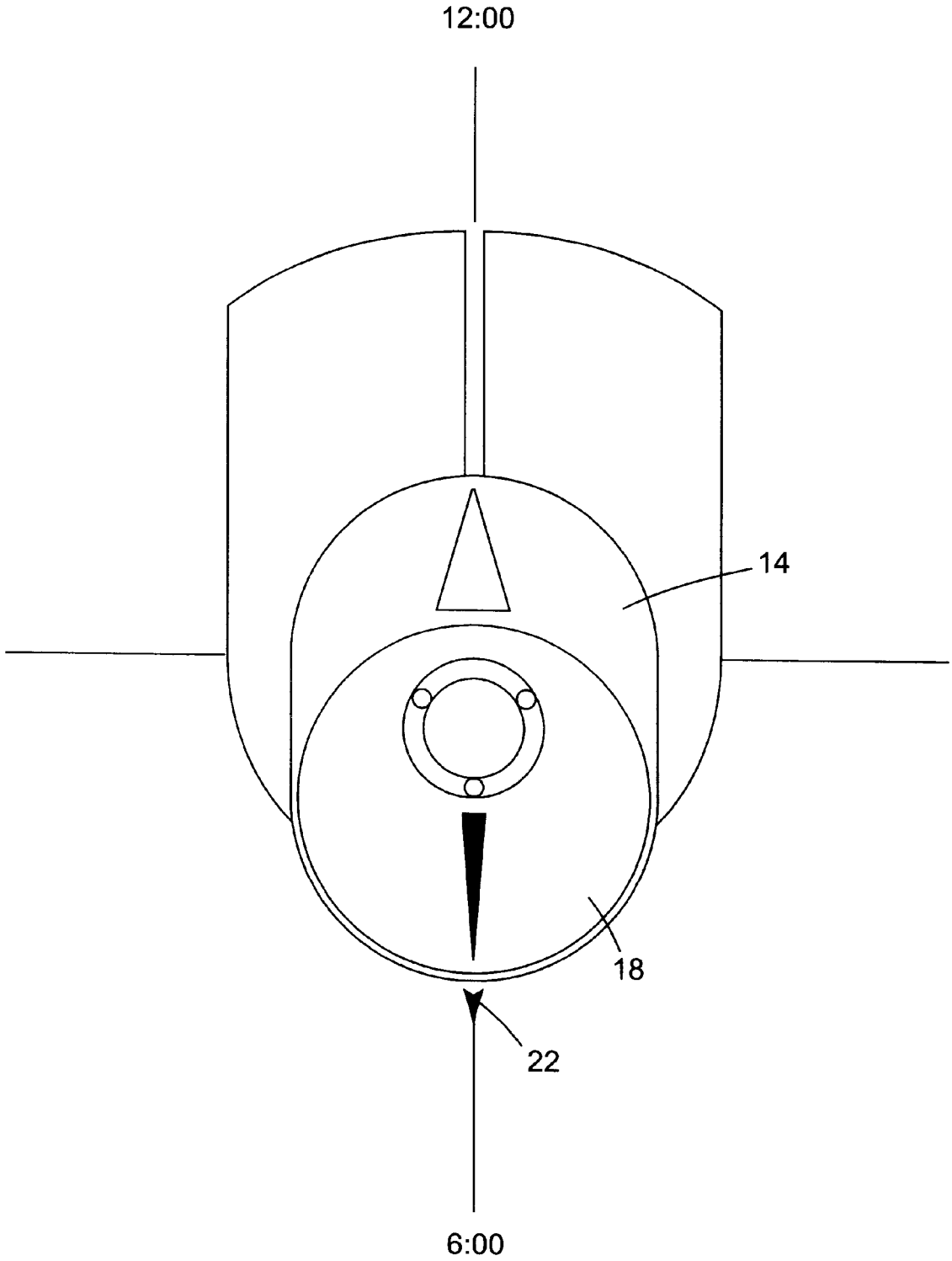
Figure 10:
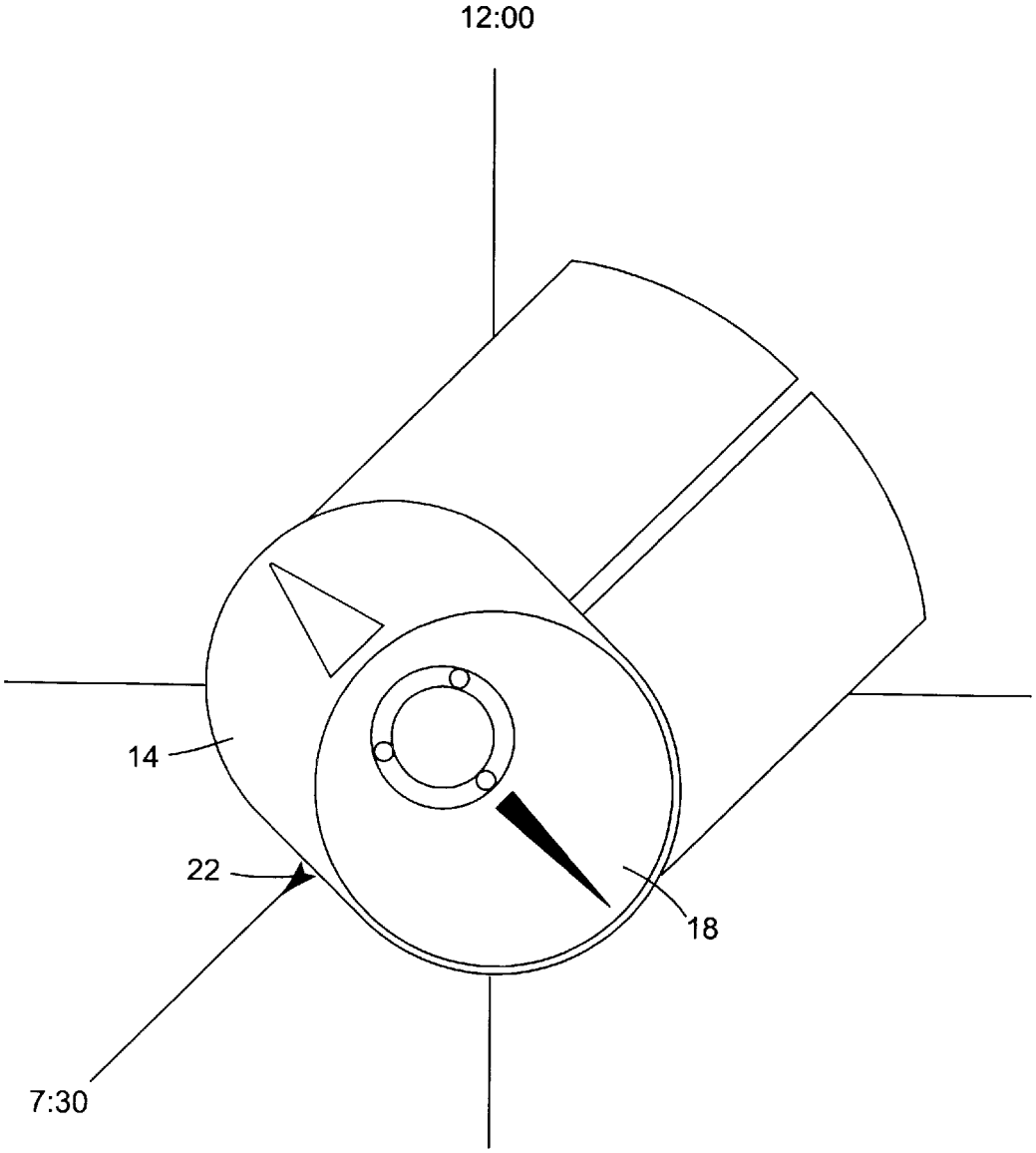
Figure 11:
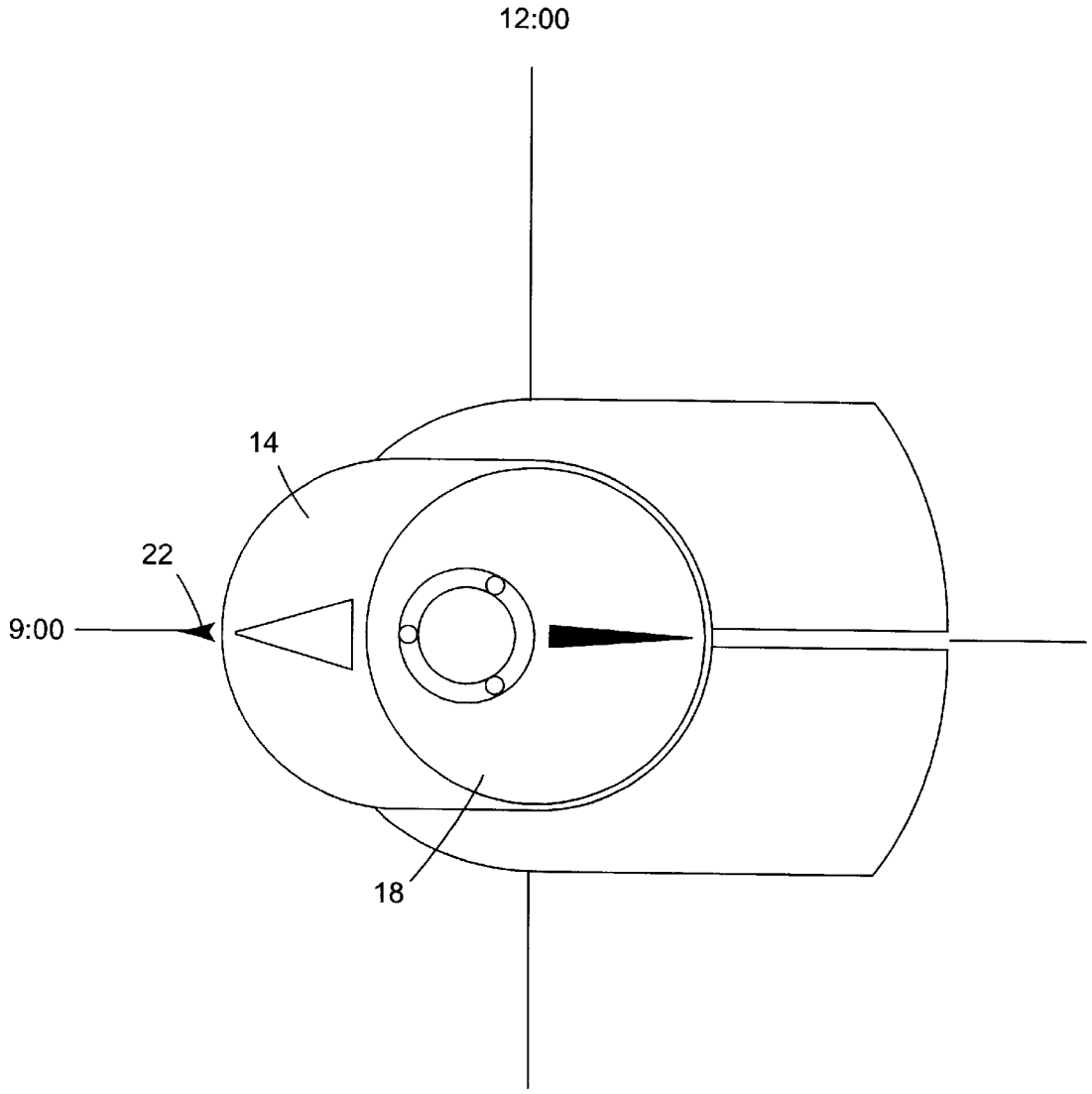
Figure 12:
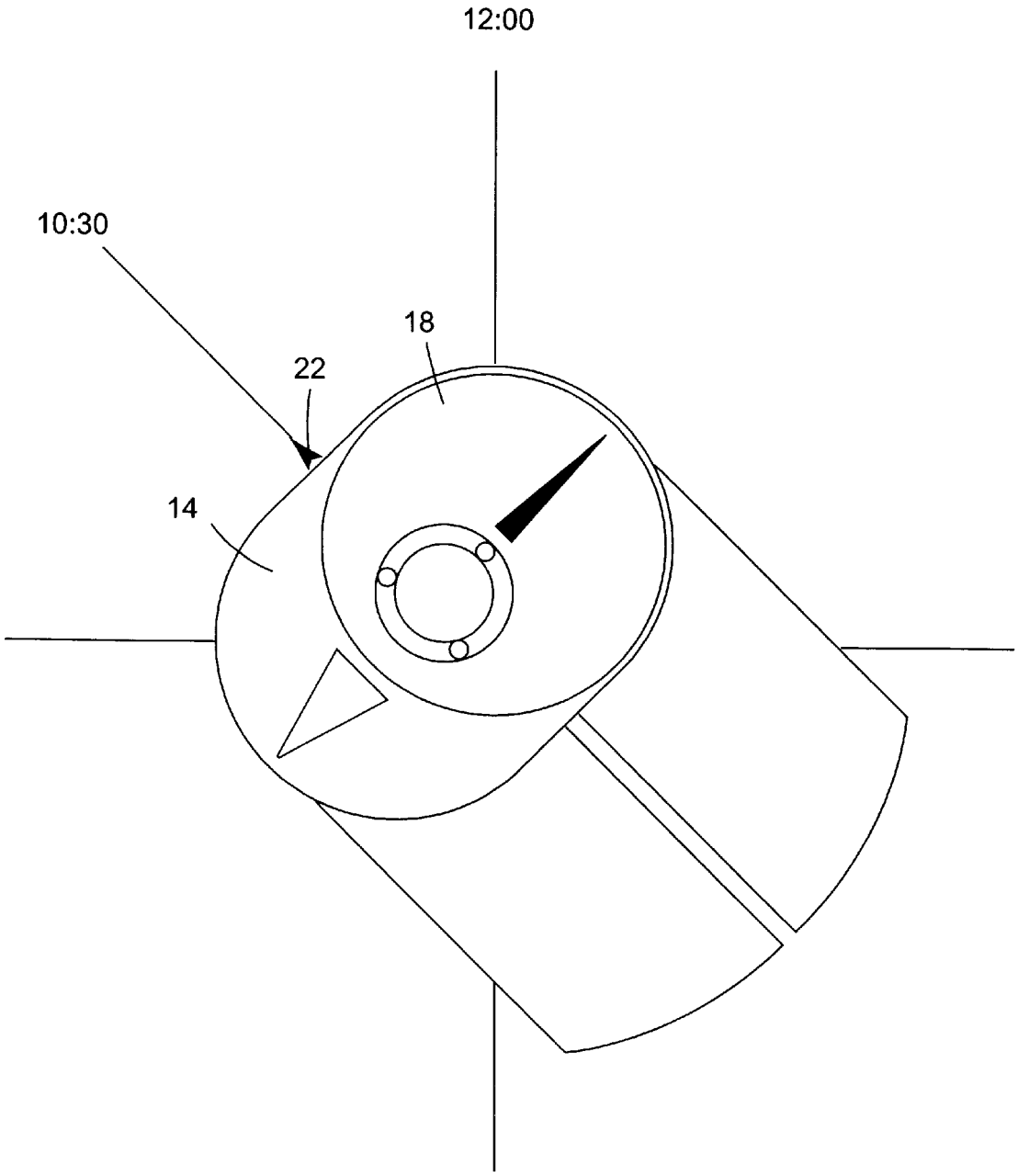

If the engine is a two stroke four cylinder engine, the firing sequence of pistons 1–4 will be 4,1,3,2. With this firing sequence the primary crank 22 will rotate in a clockwise direction as viewed in FIG. 1, while the first and second cranks 14,18 will rotate in an antic-clockwise direction. FIG. 5 shows the position with the primary crank 22 and the second crank 18 at twelve o'clock, and the first crank 14 at six o'clock (the positions of first and second cranks 14,18 being described with reference to primary crank 22). The subsequent Figures show the positions of the cranks during one complete cycle. Upon rotation into the position of FIG. 6 the primary crank 22 is at a position corresponding to half-past one, crank 14 is at half-past four, crank 18 is at half-past ten. In FIG. 7 primary crank 22 has advanced to three o'clock, crank 14 is also at three o'clock, while crank 18 is at nine o'clock. In FIG. 8 primary crank 22 is at half-past four, first crank 14 is at half-past one, second crank 18 is at half-past seven. In FIG. 9 primary crank 22 is at six o'clock, crank 14 is at twelve o'clock, and crank 18 is at six o'clock. In FIG. 10 the primary crank 22 is at half-past seven, first crank 14 is at half-past ten, second crank 18 is at half-past four. In FIG. 11 primary crank 22 is now at nine o'clock, first crank 14 is also at nine o'clock while second crank 18 is at three o'clock. Lastly in FIG. 12 primary crank 22 has advanced to half-past ten, first crank 14 is at half-past seven and second crank 18 is at half-past one. This completes one cycle.

It will be seen from FIGS. 5 to 12 that the first and second cranks 14,18 rotate in an opposite sense from the primary crank 22. The first and second cranks 14,18 each have the same radius of throw as the primary crank 22 and rotate at the same angular velocity. This means that the pistons 1,2 and 3,4 reciprocate along their axes harmonically. Furthermore because the first 14 and second 18 cranks are at 180° with respect to each other, their rotations balance each other out.

In the engine of the present invention one advantage is that while the linear velocities of the cranks 14,18 along the x-x and y-y axes are variables depending on the angular position of the primary crank 22, provided that the angular velocity of crank 22 is constant the sum of the kinetic energies of the pistons 1,2 and 3,4 is constant. Similarly although the linear accelerations and decelerations of the cranks 14,18 along the x-x and y-y axes are dependent on the angular position of primary crank 22, again provided that the angular velocity of the primary crank 22 is constant the sum of the acceleration vectors of the pistons 1,2 and 3,4 corresponds to a constant centrifugal force acting through the centre O towards the primary crank 22 and which can be finely balanced by a counterweight.

Figure 15:
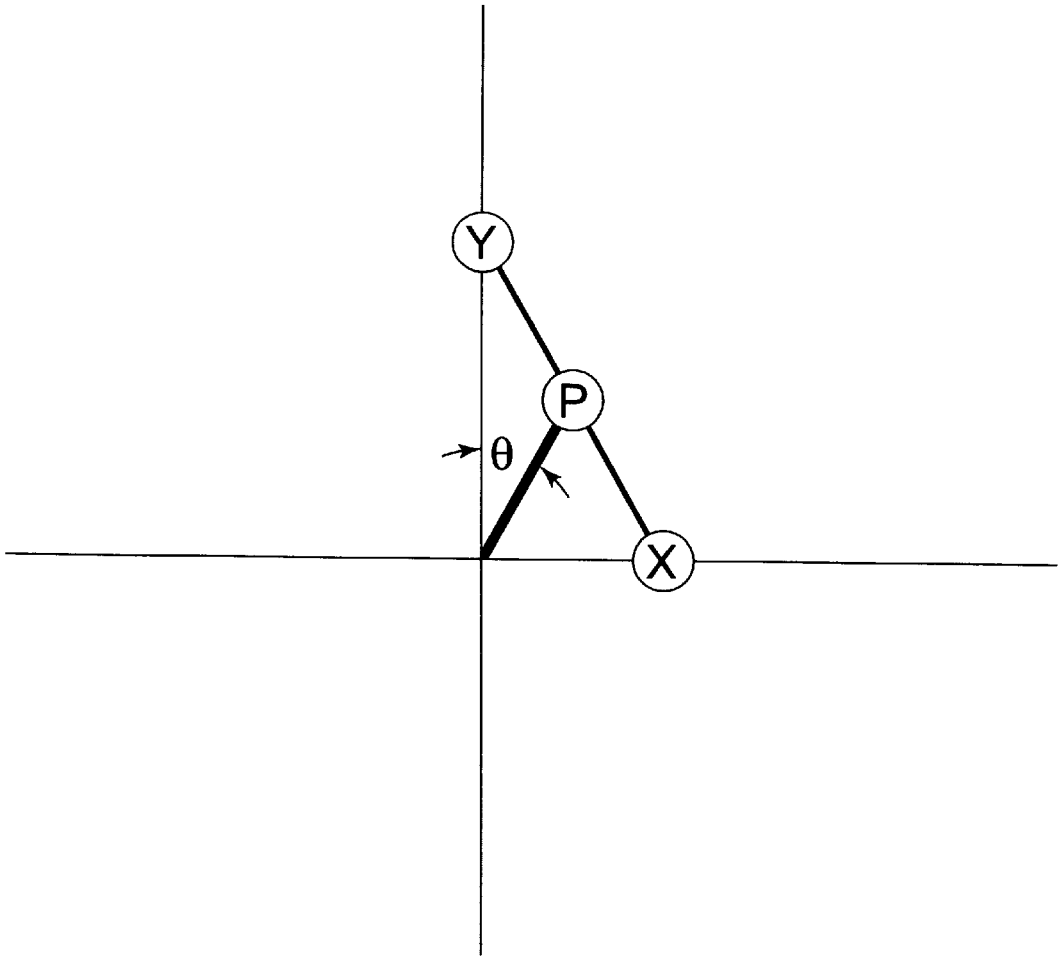

This can be seen by the following analysis, which is best understood with reference to FIG. 15 which schematically shows the positions of cranks 14 (<X>), 18 (<Y>) and 22 (<P>) and in which the radii of throw of the cranks r=ØP=PX=PY, mass of <X> Mx=mass of <Y> My=$K_2$, and angular velocity=dθ/dt=$K_1$. <P> is rotating about Ø (the z-axis) in a clockwise direction at an angular velocity of $K_1$ while <X> and <Y> rotate about <P> in a anti-clockwise direction with the same angular velocity. With this situation the following conclusions can be drawn about the position, velocity, kinetic energy and acceleration of the pistons as they move along the X and Y axes.

| | | |
|---|---|---|
| Position | <Y> = 2rcosθ | <X> = 2rsinθ |
| Velocity | dy/dθ = −2rsinθ | dx/dθ = 2rcosθ |
| | dy/dt = dy/dθ.dθ/dt | dx/dt = dx/dθ.dθ/dt |
| | dy/dt = −2rsinθ.$K_1$ | dx/dt = 2rcosθ.$K_1$ |

Thus the sum of the kinetic energy $$\tfrac{1}{2}My(dy/dt)^2+\tfrac{1}{2}Mx(dx/dt)^2=\tfrac{1}{2}K_2(2r)^2(K_1)^2$$

which is a constant

The acceleration can be calculated as follows $$d^2y/dt^2=-2rK_1\cos\theta \quad d^2x/dt^2=-2rK_1\sin\theta$$

and the vector sum of the acceleration along the X and Y axes is $2rK_1$ in the direction of ØP. This corresponds to a constant centrifugal force in the direction of the Z-axis which can easily be balanced by a counter-balancing weight.

In summary it will be seen that the pistons are driven by the first and second cranks 14,18 which rotate about the primary crank 22. At the same time the primary crank 22 rotates about the z-z axis in the opposite sense to the rotation of the first and second cranks about the primary crank. The throw of the first and second cranks from the primary crank is equal to the throw of the primary crank from the z-z axis. The counter-balancing weight is fixed opposite the primary crank and rotates therewith.

In a conventional internal combustion engine any lateral forces acting on the pistons are taken up by the guide rails guiding movement of the piston in the engine block and by the cylinder walls. In conventional engines these lateral forces can be substantial and therefore this imposes design constraints upon the construction of the engine block and the cylinders. In particular the cylinder walls have to be constructed from a material strong enough to bear these lateral forces. This is disadvantageous because it does not allow the use of ceramic materials in the construction of the cylinders. Ceramic materials have excellent wear characteristics and also have very good heat resistant properties, but they also tend to be brittle which means they are liable to crack or break under lateral forces. In the internal combustion engine of the present invention, however, the forces acting on the pistons can be finely balanced to remove or at least substantially reduce any such lateral forces and ceramic materials may be used in the cylinder construction.

Preferably, however, if a cylinder is to be constructed from ceramic materials it must be pre-stressed. One way of achieving this is to wind a steel wire around the ceramic cylinder. This has drawbacks, however, in that the tension in the wire reduces when it expands under the action of heat, and also in that the steel wire hinders the dissipation of heat by convection.

Figure 13:
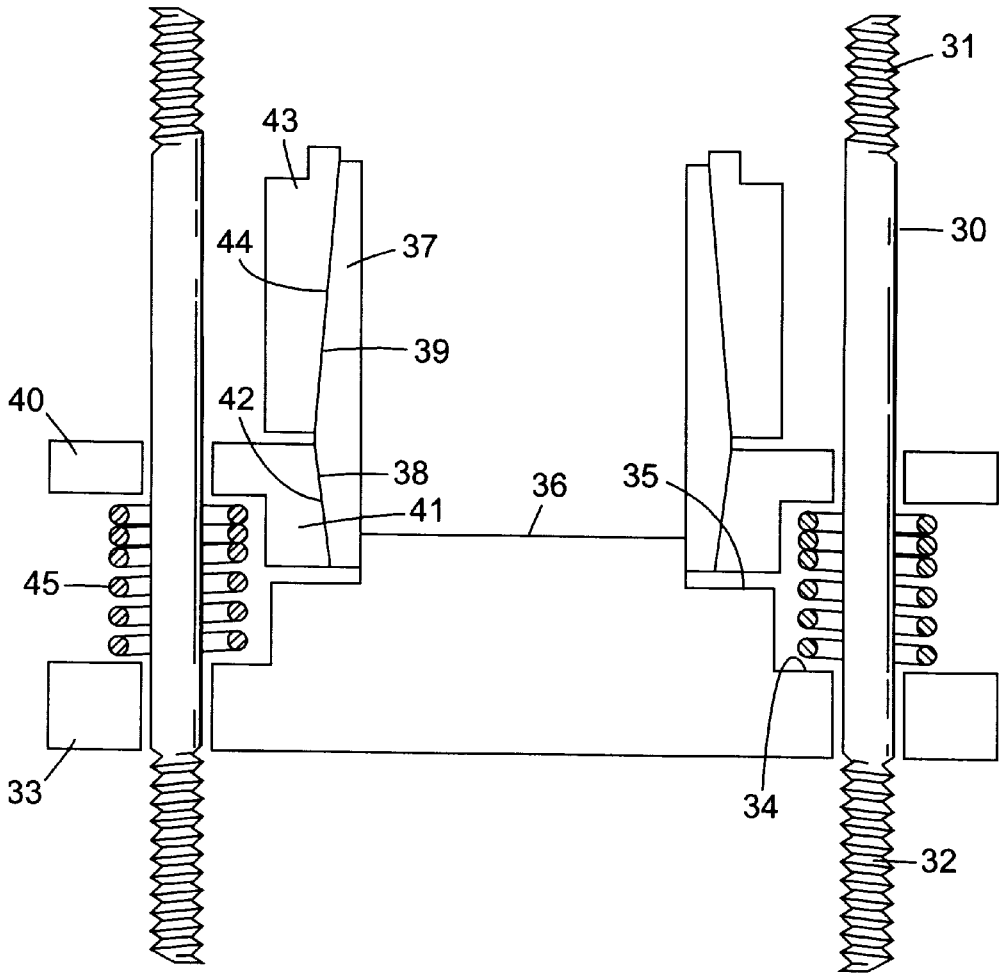
FIG. 13 is cross-section through a cylinder.

The present invention provides an alternative method for pre-stressing the ceramic cylinders. FIG. 13 shows an exemplary cylinder in cross-section. The cylinder is located between four rectangularly disposed shafts 30. The shafts are provided with threaded end portions 31,32; threaded portions 31 fix the cylinder to the engine bock, while threaded portions 32 allow a cylinder end plate 33 to be located—the end plate 33 having threaded screw holes at its four corners to receive threaded end portions 32 of shafts 30.

Cylinder end plate 33 has a stepped surface that defines by way of two stepped portions 34,35 the cylinder end surface 36. The cylinder wall is defined by an annular cylinder wall portion 37 one end of which is received abutting against stepped portion 35 of the cylinder end plate 33. The cylinder wall portion 37 has a smoothly cylindrical interior surface to define a space for sliding movement of the piston head. The exterior surface of the cylinder wall portion 37, however, is formed with tapered surfaces 38,39 such that the thickness of the wall portion 37 increases away from the cylinder end plate 33 until it reaches a maximum and then decreases again.

Surrounding the portion of the cylinder wall portion 37 closest to the cylinder end plate 33 is an annular pressure means comprising plate 40 similarly sized to cylinder end plate 33 and having four apertures corresponding to the positions of shafts 30 so as to allow plate 40 to slide to and fro along the shafts 30. Plate 40 has an inner annular portion 41 having a tapered surface 42 complementary to surface 38 of cylinder wall portion 37 and being in close engagement therewith. Spring means 45 are provided between cylinder end plate 33 and plate 40 so as to urge plate 40 away from cylinder end plate 33. Surrounding tapered portion 39 of cylinder wall portion 37 is a locking ring 43 having a tapered inner surface 44 complementary to tapered surface 39.

It will thus be understood that the effect of the spring means is to urge the plate 40 in a direction such that the tapered inner surface 42 acts on tapered portion 38 of cylinder wall portion 37 so as to urge portion 38 inwardly. Thus an external pressure is provided around the periphery of the cylinder so as to prevent the ceramic cylinder from cracking under the internal pressure of combustion. Plate 40 and locking ring 43 are preferably both made of aluminium for better heat dissipation. It will also be understood that the springs are not in contact with the cylinder and so do not present any obstacle to heat dissipation.

Figure 14:
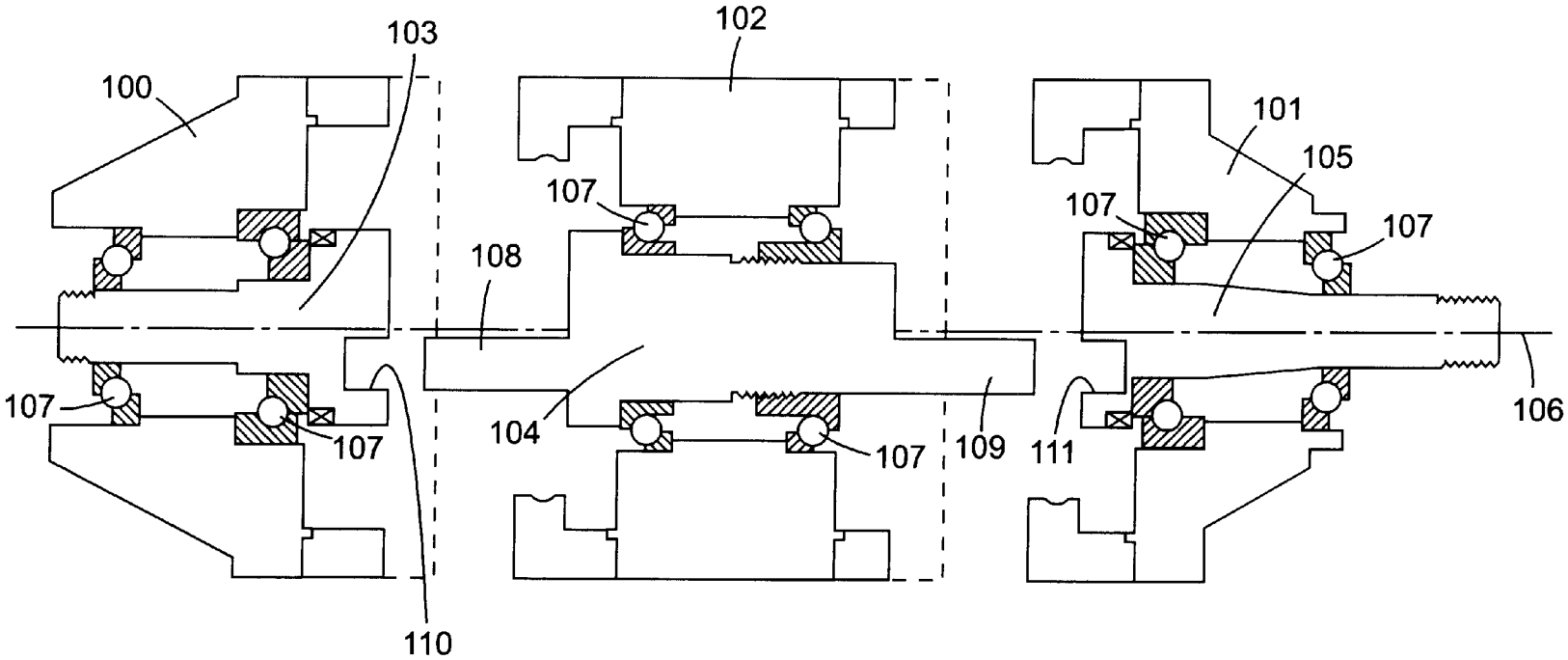
FIG. 14 is a section through an embodiment of the invention in the form of an eight-cylinder engine, and FIG. 15 schematically illustrates the cranks for the purposes of explanation.

The embodiment described above is a four-cylinder engine. However the invention is equally applicable to an engine having a greater number of cylinders and FIG. 14 shows a sectional view through an engine block for an eight-cylinder embodiment. In this embodiment the engine block may be regarded as comprising three sections: two end sections 100,101 and a middle section 102. Extending through the engine block is a crankshaft that may also be regarded as being made up of three sections 103,104,105. In FIG. 14 the three sections are shown as being slightly separated, but this is for clarity of illustration only and in reality the three sections 103,104,105 are connected together so that they rotate as one shaft.

Each crankshaft section 103,104,105 is adapted to rotate about a common axis 106, and each crankshaft section is rotatably mounted within respective engine block sections 100,101,102 by two annular bearing sets 107 per engine block section. Each engine block section 100,101,012 is provided with annular bearing sets at each end of the crankshaft section 103,104,105 which in addition to rotatably supporting the crankshaft sections 103,104,105 define spaces therebetween which may be used for other components. For example a lubricating pump may be located in the space defined in engine block section 100.

As can be seen from FIG. 14 crankshaft section 104 is formed with two projecting axles 108,109 extending from opposite ends of the section 104 and parallel to but displaced from the central axis of rotation 106 of the crank shaft sections 103,104,105. Crank shaft sections 103,105 are provided with corresponding recesses 110,111 for locating the ends of the axles 108,109 such that the three crank shaft sections come together to form a single commonly rotating crank shaft. It will be seen, however, that the recesses are shallower than the length of the axles 108,109 such that when the axles 108,109 are received in the recesses 110,111 there exists a space surrounding the axles between the ends of the crank shaft sections. Two such spaces are defined: one between crank shaft sections 103 and 104, and the other between sections 104 and 105. Into each such space—and fitted over the respective axles 108,109—are located first and second cranks corresponding to first and second cranks 14,18 in the first embodiment described above. Thus four pistons may be driven in their respective cylinders by cranks located between engine block sections 100,102 and another four may be driven by cranks located between engine block sections 102,101. This engine therefore has two sets of four cylinders disposed in mutually parallel planes.

In this embodiment, in respect of the pistons located between engine block portions 100,102 and between portions 102,101, the crank shaft portion 104 functions as the equivalent of the primary crank 22 of the first embodiment. At the same time since the first crank shaft portion 103 and third crank shaft portion each have a weight offset caused by the presence of recesses 110,111 and so these portions can function as the respective counter-balancing weights.

What is claimed is:

1. An engine comprising of at least two pairs of pistons and cylinders, said pairs being disposed along mutually orthogonal first and second axes, said pairs being driven by respective first and second cranks, said first and second cranks rotating about a common crank pin and said crank pin being integrally formed with a primary crank, said primary crank rotating about a third axis orthogonal to said first and second axes, said first and second cranks having a radius of throw from said primary crank equal to the radius of throw of said primary crank from said third axis, wherein each said piston pair are formed integrally with and extend in opposite directions from a central piston body, said central piston body being formed with guide wheels for engaging guide rails formed within an engine block whereby said central piston body and said pistons may reciprocate within associated cylinders, and wherein each said central piston body is formed with an aperture for receiving the respective crank of the other said piston pair.

2. An engine as claimed in claim 1 wherein a counter-balancing weight is provided opposite from said primary crank for rotation about said third axis.

3. An engine as claimed in claim 1 wherein said engine is a four-cylinder engine having two pairs of cylinders disposed on two orthogonally disposed axes.

4. An engine as claimed in claim 1 wherein said engine is an eight-cylinder engine having four pairs of cylinders, said cylinders being disposed in two groups of four, said two groups being disposed in parallel planes and mutually orthogonal pairs within each said plane.

5. An engine as claimed in claim 1 wherein said cylinders are formed of ceramic material.

6. An engine as claimed in claim 5 wherein said cylinders are pre-stressed.

7. An engine as claimed in claim 6 wherein each said cylinder is formed with an at least partially tapered external surface, and wherein an annular surrounding member is provided with an internal surface tapered in an opposite sense to said tapered external surface of said cylinder, and wherein urging means are provided for urging said surrounding member such that said tapered surfaces are brought into engagement to generate a radially inwardly directed force.

8. An engine as claimed in claim 7 wherein said urging means comprises spring means.

9. An engine as claimed in claim 7 wherein an annular locking member is provided surrounding a second tapered external surface of said cylinder, said locking member having an internal tapered surface of an opposite sense to the second tapered external surface of said cylinder.

10. An engine having four pairs of pistons and cylinders, said four pairs being grouped into two groups of two pairs in each group, the piston and cylinder pairs in each group being disposed on mutually orthogonal first and second axes and being driven by first and second cranks respectively, said first and second cranks rotating about a common crank pin and said crank pin and said crank pin being integrally formed with a primary crank, said primary crank rotating about a third axis orthogonal to the first and second axes and comprising three interconnecting sections, junctions between said three sections defining spaces for receiving the respective first and second cranks of said two groups of pistons and cylinders, each said first and second crank having a radius of throw from said primary crank equal to the radius of throw of said primary crank from said third axis, and a counterbalancing weight being provided at each junction opposite said primary crank, wherein each said piston pair are formed integrally with and extend in opposite directions from a central piston body, said central piston body being formed with guide wheels for engaging guide rails formed within an engine block whereby said central piston body and said pistons may reciprocate within associated cylinders, and wherein each said central piston body is formed with an aperture for receiving the respective crank of the other said piston pair of said group.

11. A cylinder for an engine wherein said cylinder is formed of ceramic material, and wherein said cylinder has an external surface having two portions tapering in opposite senses, and wherein an annular surrounding member having an internal surface tapering in an opposite sense to a first of said two portions surrounds said first of said two portions, and wherein urging means acts upon said surrounding member whereby the tapering internal surface of said surrounding member and said first tapering portion of said external surface of said cylinder are brought together to generate a radially inwardly directed force, and wherein an annular locking member surrounds said second tapering portion of the external surface of said cylinder and having an internal tapering surface of opposite sense to the said second tapering portion.

* * * * *